US006705678B1

(12) United States Patent
Albright et al.

(10) Patent No.: US 6,705,678 B1
(45) Date of Patent: Mar. 16, 2004

(54) HEIGHT-ADJUSTABLE CHAIR BACK

(75) Inventors: Scott Albright, Nashville, TN (US); Lance Lindenberg, Lavergne, TN (US)

(73) Assignee: First Source Furniture Group LLC, Nashville, TN (US)

( * ) Notice: Subject to any disclaimer, the term of this patent is extended or adjusted under 35 U.S.C. 154(b) by 0 days.

(21) Appl. No.: 10/267,422

(22) Filed: Oct. 9, 2002

(51) Int. Cl.[7] ..... A47C 7/40
(52) U.S. Cl. ..... 297/353
(58) Field of Search ..... 797/353, 411.36, 797/344.18

(56) References Cited

U.S. PATENT DOCUMENTS

| | | | | |
|---|---|---|---|---|
| 518,097 A | | 4/1894 | Derby | |
| 735,313 A | | 8/1903 | Stubbs | |
| 2,030,635 A | | 2/1936 | Horwitt et al. | |
| 2,091,733 A | | 8/1937 | Hemminger et al. | |
| 2,599,301 A | | 6/1952 | Van Buren | |
| 2,637,371 A | * | 5/1953 | Boutin | 297/353 |
| 2,942,651 A | | 6/1960 | Binding | |
| 2,988,398 A | | 6/1961 | Hamilton | |
| 3,291,527 A | | 12/1966 | Hall et al. | |
| 5,374,102 A | * | 12/1994 | Archambault et al. | 297/344.13 |
| 5,664,835 A | * | 9/1997 | Desanta | 297/353 |
| 5,667,274 A | | 9/1997 | Blackman | |
| 5,904,398 A | | 5/1999 | Farricielli | |
| 6,158,810 A | | 12/2000 | Galloway | |
| 6,352,307 B1 | * | 3/2002 | Engman | 297/353 |

FOREIGN PATENT DOCUMENTS

| | | |
|---|---|---|
| EP | 0 049 700 | 4/1982 |
| GB | 2 041 439 | 9/1980 |

* cited by examiner

*Primary Examiner*—Peter R. Brown
(74) *Attorney, Agent, or Firm*—Flynn, Thiel, Boutell & Tanis, P.C.

(57) ABSTRACT

An improved chair having a simplified height-adjustable back arrangement. The back arrangement is defined principally by a back shell provided with support sleeves adjacent opposite sides thereof. The support sleeves are slidably supported on respective uprights which project upwardly adjacent opposite sides of the chair seat. A manually-releasable latching mechanism cooperates between each support sleeve and its respective upright whereby a seated occupant, by using right and left hands, can simultaneously release both latching mechanisms and effect vertical slidable displacement of the back shell to adjust the position thereof.

17 Claims, 12 Drawing Sheets

HEIGHT-ADJUSTABLE CHAIR BACK

FIELD OF THE INVENTION

This invention relates to a chair as typically used in offices and the like and, more specifically, to a chair having an improved back arrangement employing a back shell slidably supported on a pair of uprights projecting upwardly from adjacent opposite sides of the chair seat, and which employs manually-releasable latching mechanisms cooperating with each of the uprights to permit height adjustment of the back arrangement.

This invention also relates to a chair of the type typically used in offices and the like which, more specifically, incorporates an improved adjustment mechanism cooperating with the chair arms for permitting manual adjustment of the arms into one of several different selectable positions.

BACKGROUND OF THE INVENTION

Chairs, and particularly office-type chairs, are conventionally provided with a height-adjustable back arrangement. Such arrangements are typically constructed from a significant number of different parts so that the resulting construction is complex and expensive to manufacture, and oftentimes bulky, so that the aesthetics of the back are impaired. Such back arrangements also frequently employ a height-adjusting mechanism positioned at least partially internally of the back arrangement, generally centrally thereof, and such mechanism further increases the structural complexity and spatial requirements of the back arrangement. The back height-adjusting mechanism is, in many instances, also disposed so that manual release thereof involves an actuator which is accessible solely from the back side of the chair, and as such the release actuator not only impairs the aesthetics of the chair back, but also is inconvenient to utilize since back height-adjustment can not be effected while the occupant remains seated in the chair.

Chairs, particularly those used in office or similar working environments, are also typically provided with arms disposed adjacent opposite sides of the seat, and such arms are frequently supported by appropriate adjustment mechanisms which permit the height and/or horizontal position of the arm to be selectively varied. While numerous mechanisms have been developed for permitting vertical or horizontal positional adjustment of chair arms, most of these mechanisms involve a large number of parts which result in undesired structural complexity and spatial requirements, and as such impair the desired aesthetics of the arm arrangement.

Accordingly, it is an object of this invention to provide an improved chair having a simplified height-adjustable back arrangement associated therewith. The back arrangement, in a preferred embodiment, is defined principally by a back shell provided with support parts, such as sleeves, adjacent opposite sides thereof. The support sleeves are slidably supported on respective uprights which are joined to and project upwardly adjacent opposite sides of the chair seat. A manually-releasable latching mechanism cooperates between each support sleeve and its respective upright whereby a seated occupant, by using right and left hands, can simultaneously release both latching mechanisms and effect vertical slidable displacement of the back shell to adjust the position thereof.

In the improved chair of this invention, as aforesaid, the uprights preferably function to support chair arms thereon adjacent upper ends thereof. The uprights are preferably positioned adjacent but spaced slightly forwardly from rear corners of the chair seat so as to provide desired overall chair aesthetics, and to improve occupant access to the releasable latching mechanisms.

In the improved chair of the present invention, as aforesaid, the chair arms are preferably supported within the uprights by releasable height-adjusting mechanisms which can be easily manually released by the seated occupant, and which permit the height of the individual chair arms to be vertically adjusted relative to the upright. The releasable height-adjusting mechanisms which control the height of the chair arms are confined within the uprights so as to be surrounded not only by the upright but also by the support sleeve associated with the chair shell, thereby providing a construction which is compact, space saving and aesthetically desirable.

It is also an object of the invention to provide a chair, such as an office type chair, having an improved adjustment mechanism associated with and cooperating between the chair arm and the support therefore so as to permit the position of the chair arm to be readily manually adjusted. The mechanism preferably incorporates a simplified height-adjusting mechanism which is confined within the support upright for the chair arm, which mechanism involves minimal structural parts and operational complexity so as to provide a simple and compact operating arrangement. The mechanism preferably includes a release button which can be easily manually released and is positioned directly under the chair arm for ease of operation. The release button couples to an elongate trigger rod which projects vertically interiorly of the upright and, at its lower end, has an integral cam part which cooperates with and effects sideward movement of a latch plunger which is normally spring-urged into latching engagement with one of a series of latching shoulders or steps defined vertically along one side of the upright.

In the chair of the present invention, as aforesaid, the mechanism which permits movement of the chair arm also preferably incorporates a lift-and-lock mechanism cooperating with the chair arm to permit the latter to be horizontally angularly displaced between a plurality of distinct positions. This mechanism enables the chair arm to be manually lifted and then angularly displaced into a desired position, followed by lowering of the arm to lock it in the desired position. The lift-and-lock mechanism permits angular displacement to occur without affecting or disturbing the height-adjusting mechanism which is coupled therebelow and is disposed within the supportive upright.

Other objects and purposes of the invention, including structural and operational advantages thereof, will be apparent to persons familiar with constructions of this general type upon reading the following specification and inspecting the accompanying drawings.

Figure 1:
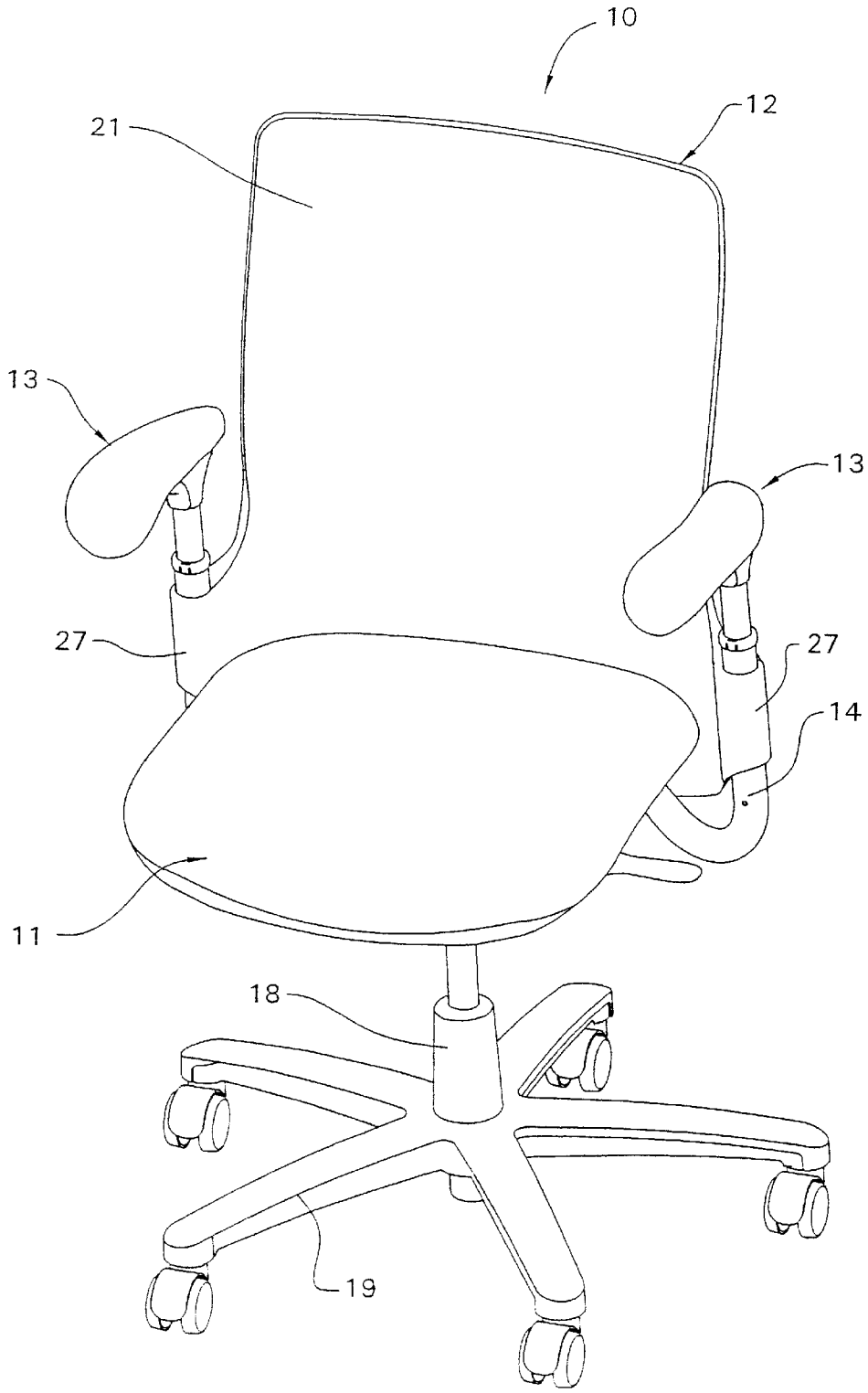
FIG. 1 is a front perspective view of a chair embodying therein the present invention.
Figure 2:
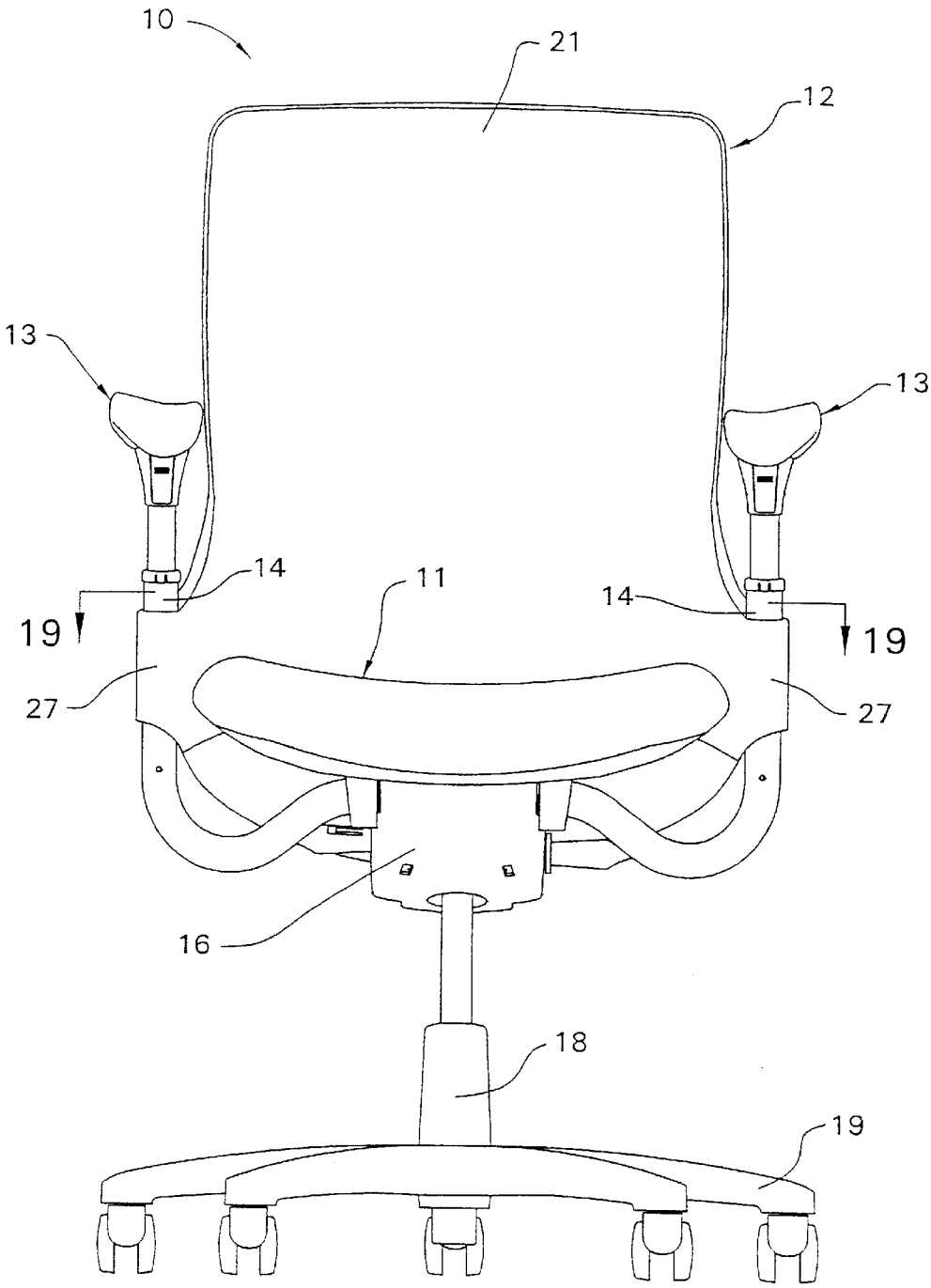
FIG. 2 is a front elevational view of the chair shown in FIG. 1.
Figure 3:
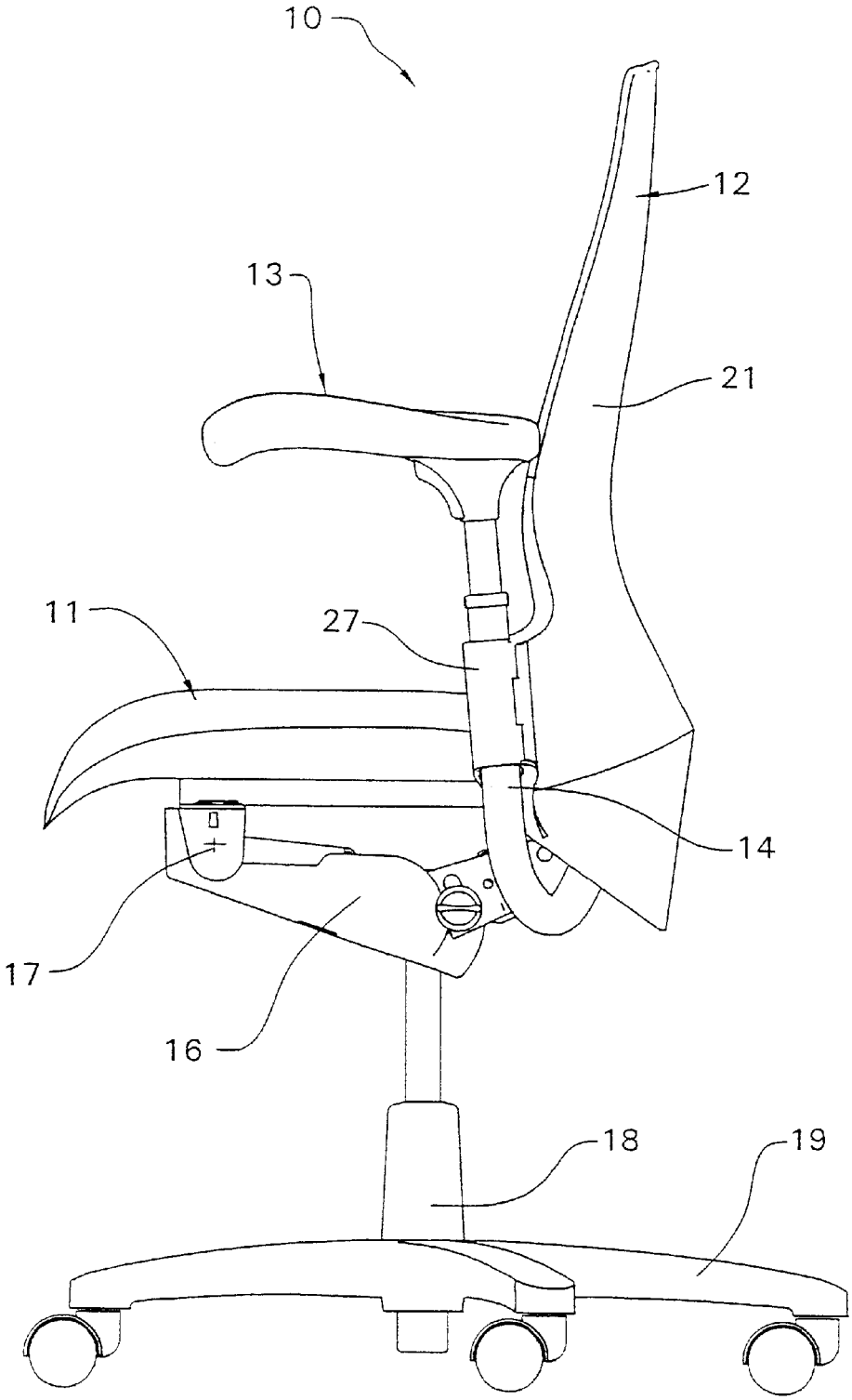
FIG. 3 is a side elevational view of the chair shown in FIG. 1.
Figure 4:
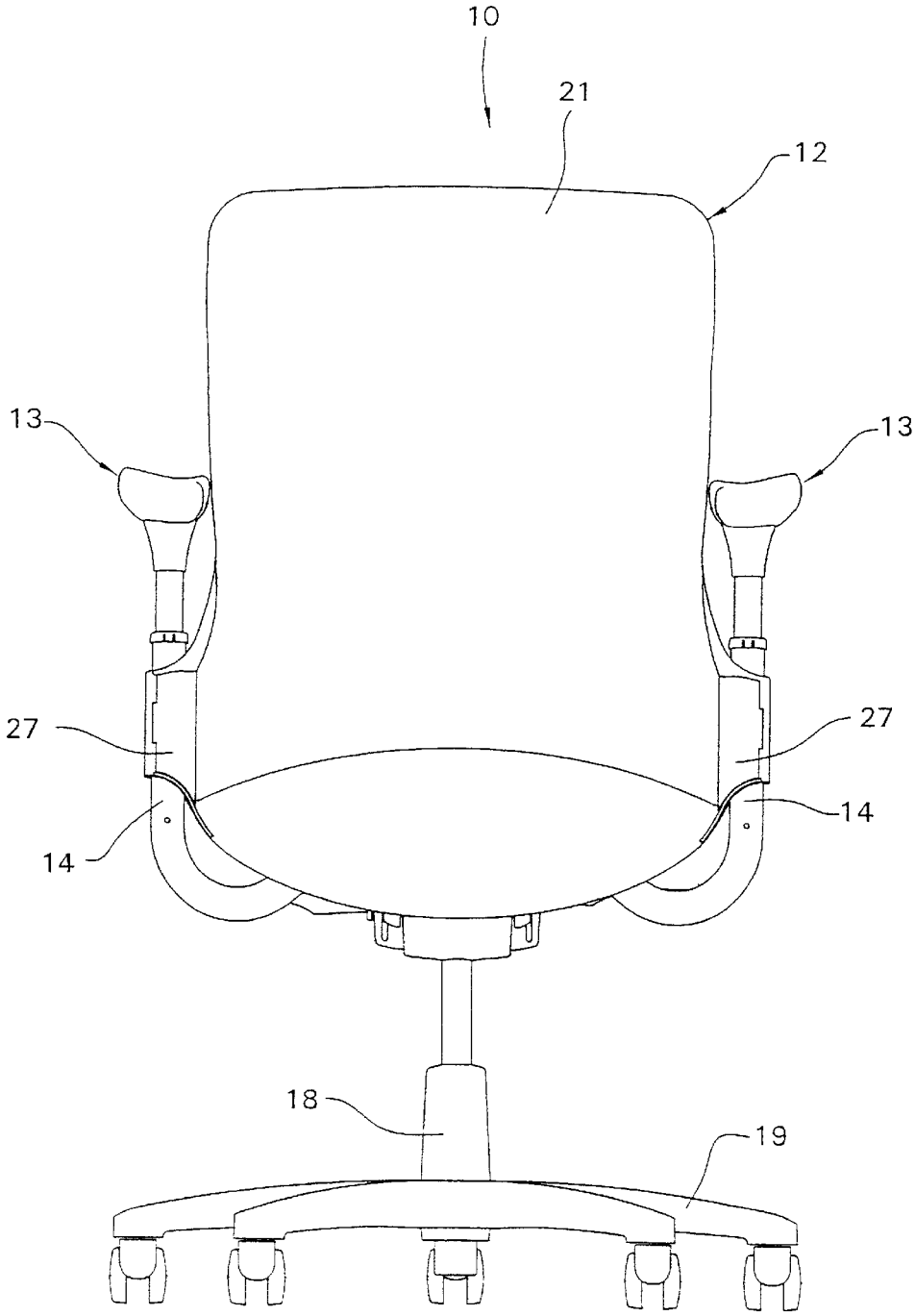
FIG. 4 is a rear elevational view of the chair shown in FIG. 1.

Certain terminology will be used in the following description for convenience and reference only, and will not be limiting. For example, the words "upwardly", "downwardly", "rightwardly", "leftwardly" will refer to directions as appearing in the drawings, and will also refer to the same directions with respect to an occupant seated in the chair. The words "inwardly", "outwardly" will refer to the geometric center of the chair and designated parts thereof. Said terminology will include the words specifically mentioned, derivatives thereof, and words of similar import.

DETAILED DESCRIPTION

Referring to FIGS. 1–4, there is illustrated a chair 10 according to the present invention, which chair is of the type conventionally used in offices and the like. The chair 10 includes a seat 11 which projects forwardly from an upwardly projecting back 12. A pair of arm rest assemblies 13 are movably supported on uprights 14 which project upwardly from adjacent opposite sides of the seat 11. A conventional chair control arrangement 16, which defines a generally horizontal tilt axis 17, connects the seat 11 to the upper end of an upright pedestal 18, the latter typically having a height-adjusting air spring associated therewith. The pedestal 18 at its lower end couples to a conventional base 19, the latter typically having a plurality of radially outwardly projecting legs provided with casters adjacent the outer ends thereof.

Figure 5:
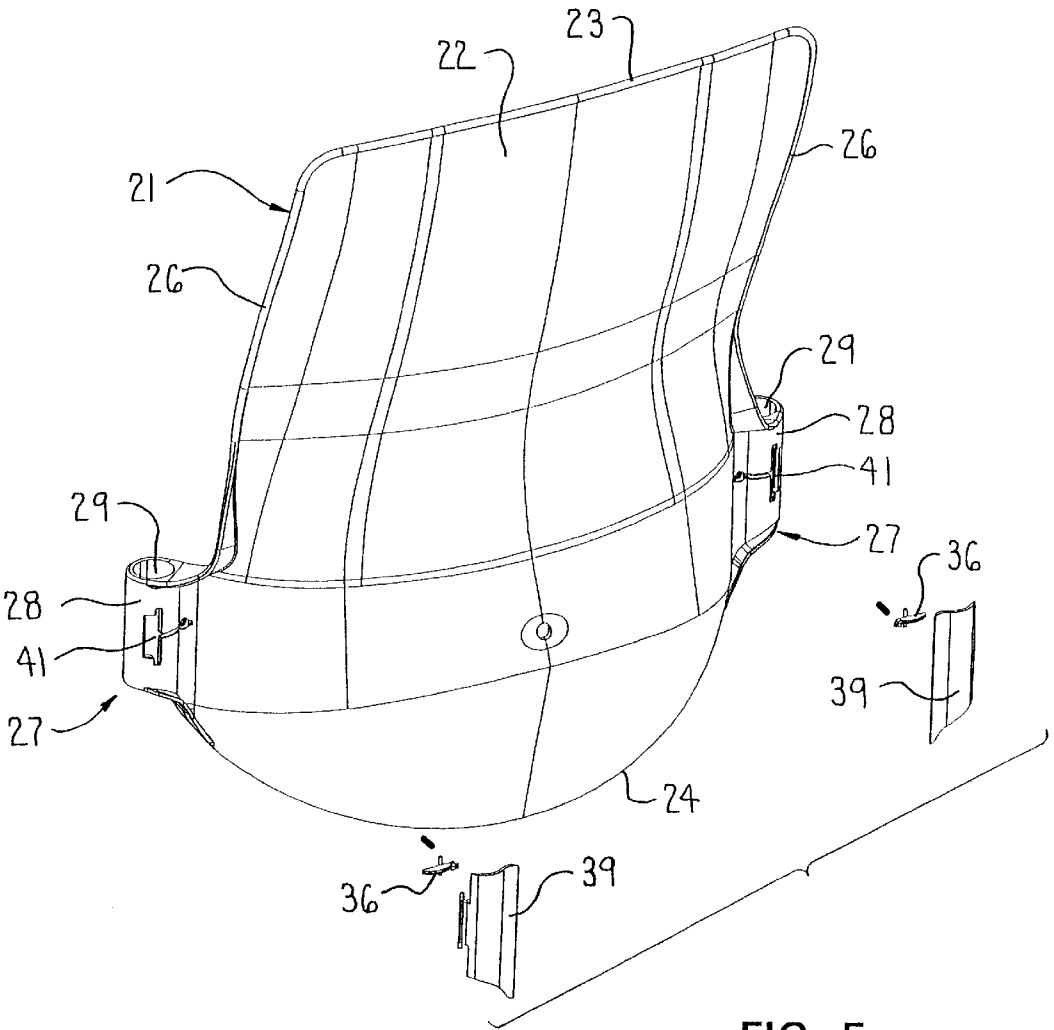
FIG. 5 is a rear perspective view of the back shell of the chair, with the height-adjusting mechanisms associated therewith shown in exploded view.
Figure 6:
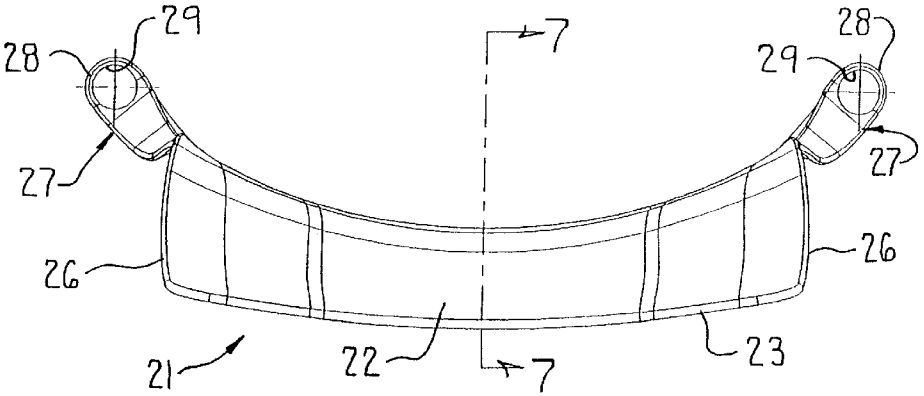
FIG. 6 is a top view of the back shell shown in FIG. 5.
Figure 7:
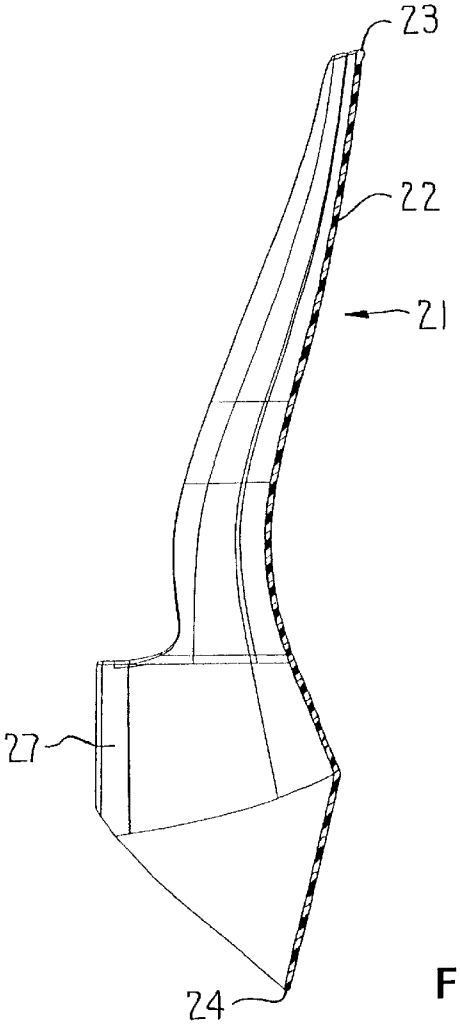
FIG. 7 is a sectional view taken generally along line 7—7 in FIG. 6.

The back 12 is defined principally by a monolithic one-piece back member or shell 21 which is typically formed of a synthetic resin material such as a plastics material. This one-piece back member 21, as illustrated in FIGS. 5–7, includes a main upright panel 22 which defines the dominant horizontal and vertical extent of the chair back for supportive engagement with the back of a seated occupant. The main panel 22 extends vertically between respective upper and lower edges 23 and 24, and extends horizontally between opposite side edges 26.

The back member 21 also includes mounting parts 27 which are monolithically and integrally fixed to and project outwardly from opposite sides of the main panel 22 in the vicinity of the lower end thereof for permitting coupling of the back member 21 to the arm uprights 14. The mounting parts 27 project outwardly and forwardly relative to the respective adjacent side edge of the main panel 22, and each includes a generally vertically elongate support sleeve 28 having a generally vertical and cylindrical opening 29 extending therethrough for accommodating the respective arm upright 14 as described below.

Figure 14:
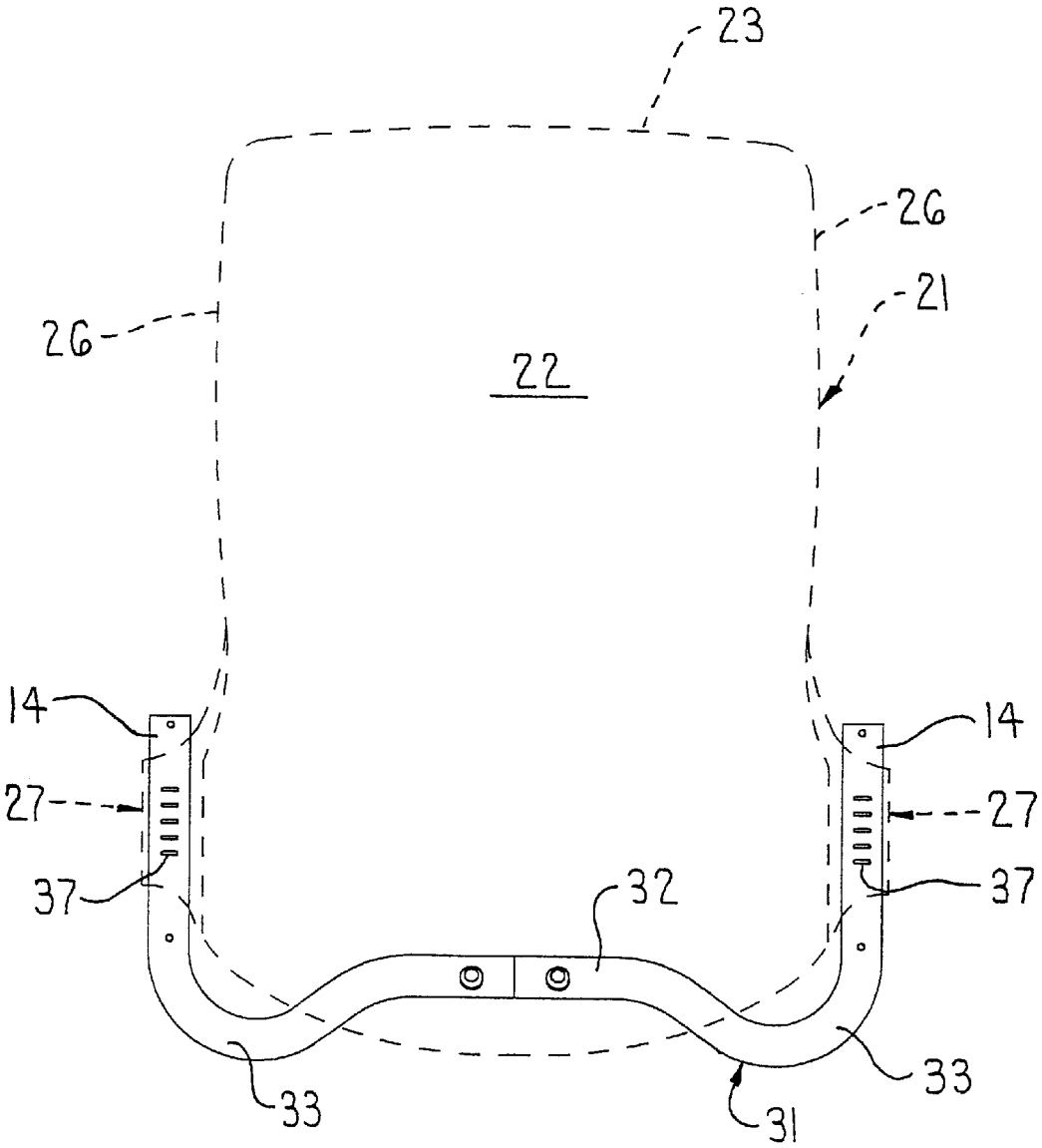
FIG. 14 shows the U-shaped arm member of the chair and its association with the back shell.

The arm uprights 14 are cantilevered upwardly in generally parallel relation from adjacent opposite sides of the chair seat 11 generally in the vicinity of the rear corners thereof. The arm uprights 14 are part of a generally U-shaped arm member 31 (FIG. 14) which has a center part 32 thereof disposed under the chair seat and rigidly joined relative thereto, such as by being secured to a part of the housing associated with the chair control. The center part 32 joins through bends 33 to the uprights 14. The U-shaped chair member 31 may be formed from a one-piece tubular element, or may be formed from two L-shaped tubular pieces which are mirror images of one another and joined to the chair seat so as to provide a generally U-shaped arrangement.

The back member 21 is vertically slidably supported on the arm uprights 14, and a manually-releasable latching mechanism 34 (FIGS. 15–16) cooperates between each mounting part 27 and its respective arm upright 14 for controlling the vertical position of the back member.

The latching mechanism 34 includes a pivoting latching lever 36 which is adapted for latching engagement within one of a plurality of slots 37 which are formed in and extend transversely relative to the exterior surface of the arm upright 14. The latching lever 36 is acted on by spring 38 which biases the latching lever into its latching position. An activating member or paddle 39 is hingedly mounted on the support sleeve 28 of the chair shell and cooperates with the latching lever 36 for permitting the latter to be moved into a released or unlatched position.

Figure 9:
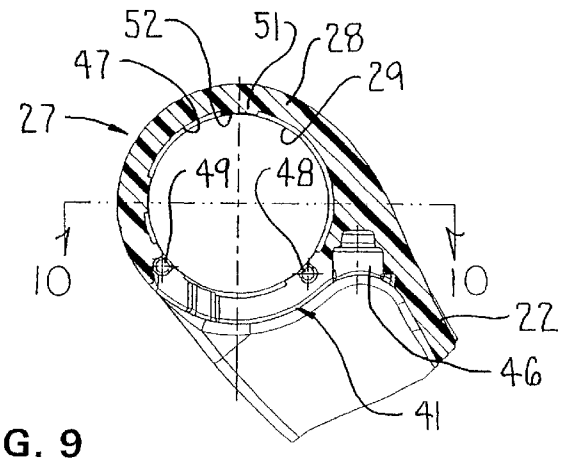
FIG. 9 is a fragmentary sectional view taken generally along line 9—9 in FIG. 8.
Figure 10:
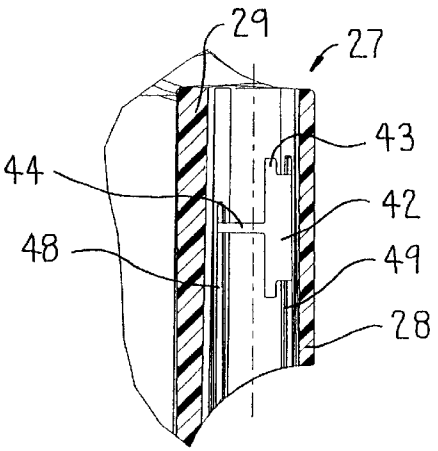
FIG. 10 is a fragmentary sectional view taken generally along line 10—10 in FIG. 9.
Figure 8:
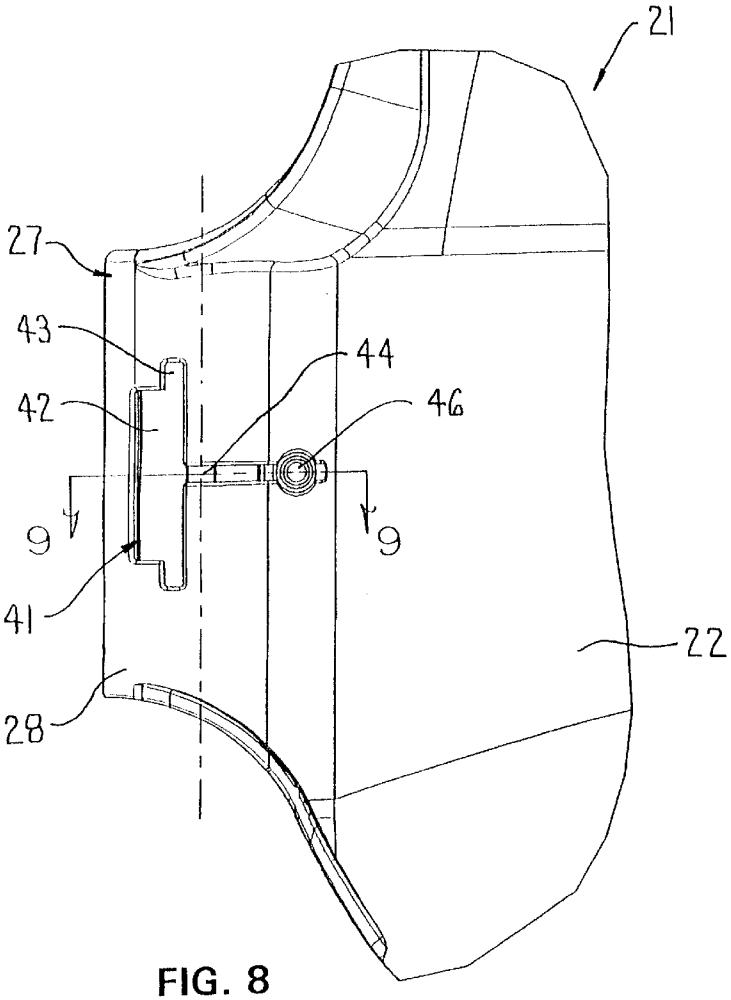
FIG. 8 is an enlarged, fragmentary back view showing the mounting part associated with one side of the back shell.

To accommodate the latching mechanism 34, and referring specifically to FIGS. 8–10, the support sleeve 28 associated with the back member 21 has a generally T-shaped opening 41 which extends transversely through the back side of the support sleeve for communication with the cylindrical opening 29 defined interiorly thereof. The T-shaped opening 41 is oriented generally horizontally and includes a generally rectangularly-shaped main opening 42 which, along a vertical edge thereof closest to the main panel of the chair back, is provided with slot-like parts 43 which are elongated upwardly and downwardly from the respective upper and lower edges of the main opening 42. The T-shaped opening 41 also includes a horizontally elongate narrow slot 44 which projects transversely away from the vertical edge of the main opening 42 which has the slot-like parts 43 associated therewith. The elongate narrow slot 44, at the end thereof remote from the main opening 42, communicates with a blind bore 46 which opens inwardly from the exterior rear surface where the support sleeve 28 merges into the main panel of the back member substantially as illustrated in FIG. 9.

The support sleeve 28 of the back shell has a first vertically elongate slot-like groove 48 formed inwardly from the inner sleeve wall 47, which groove 48 communicates with the narrow slot 44 adjacent the remote end thereof, that is, in the vicinity of the blind bore 46. This groove 48 extends vertically on both sides of the narrow slot 44, and accommodates therein a hinge pin associated with the latching lever 36 as discussed hereinafter.

The support sleeve 28 also has a further slot-like groove 49 which opens inwardly from the inner sleeve surface 47 and extends vertically therealong. This groove 49 extends vertically generally along the edge of the main opening 42 which is on the side thereof remote from the narrow slot 44. Groove 49 also projects vertically both above and below the respective upper and lower edges of the main slot 42 so as to accommodate therein a hinge pin associated with the activating paddle 39, as discussed hereinafter.

The inner surface 47 of the support sleeve 28 also has a plurality of ribs 51 extending vertically therealong in angularly spaced relationship therearound. Each of these ribs defines thereon a inner contact surface 52 which is of a partial cylindrical configuration whereby the plurality of contact surfaces 52 provides a snug but slidable supportive engagement with the arm upright 14.

Figure 18:
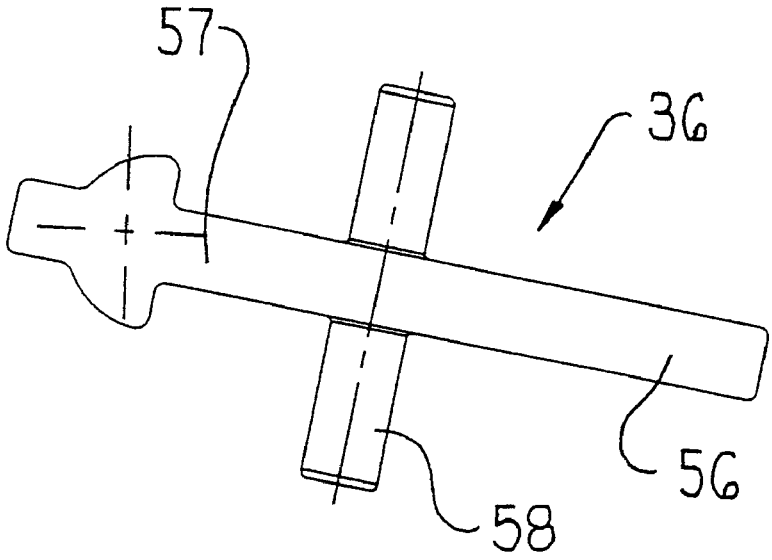
FIG. 18 is a side view of the latching lever shown in FIG. 17.
Figure 17:
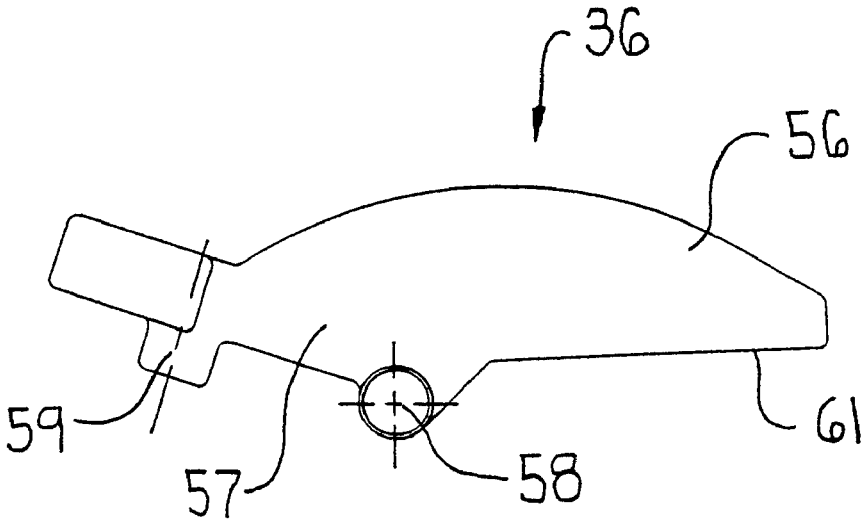
FIG. 17 is a top view showing the latching lever associated with the back shell height adjustment mechanism.
Figure 19:
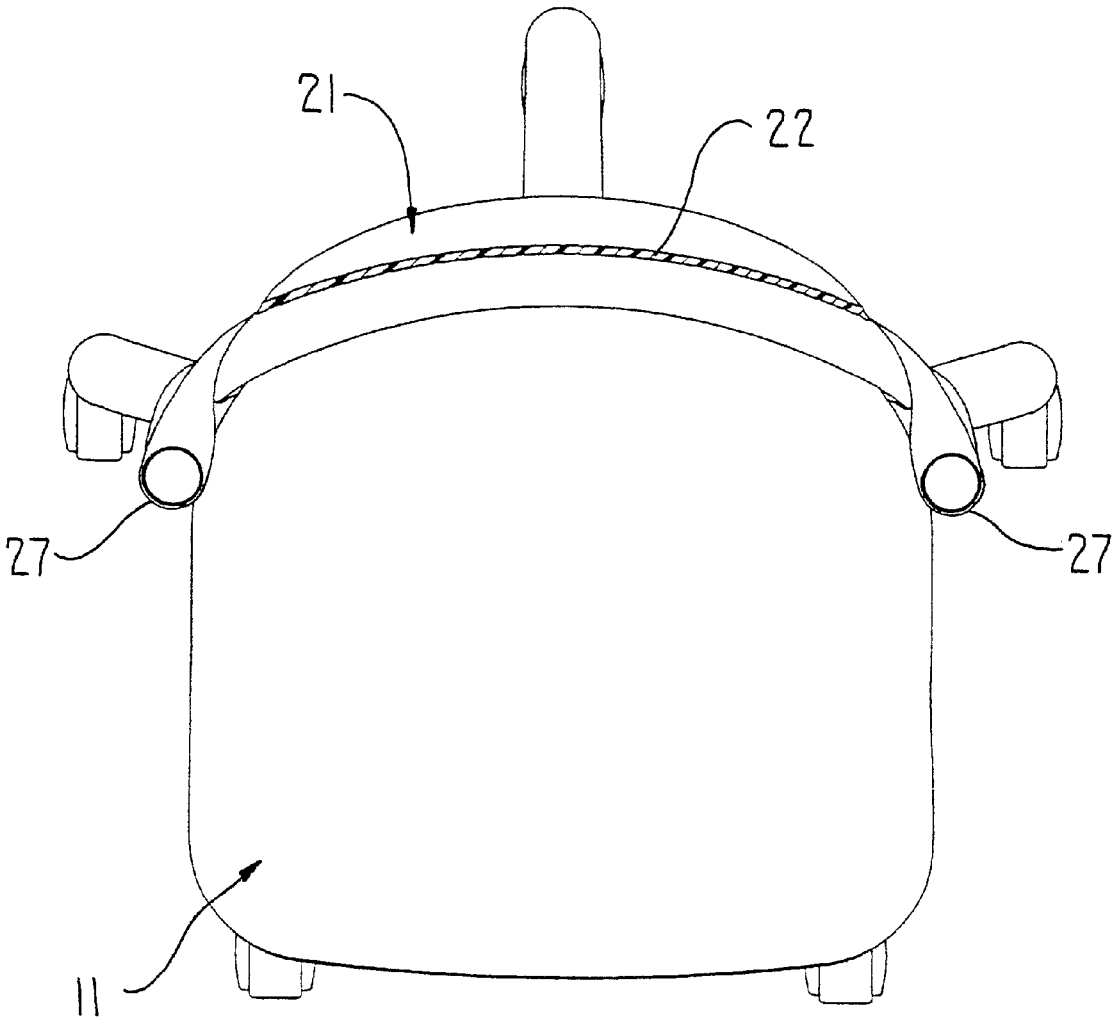
FIG. 19 is a diagrammatic plan view taken generally along line 19—19 in FIG. 2.

Considering now the construction and function of the latching mechanism 34 in greater detail, the latching lever 36 as illustrated in FIGS. 17–18 includes first and second lever parts 56 and 57, respectively, which project generally outwardly in opposite directions from a center hub or pivot pin 58, the latter projecting transversely outwardly from opposite sides of the lever member. The lever member also has a nub or pin 59 projecting outwardly from one side of the lever part 57 at a location disposed more closely adjacent the outer free end thereof. The first lever part 56 also defines a flat edge 61 extending outwardly along one side thereof.

The lever member 36 is positionally and pivotally supported on the support sleeve 28 of the chair back by initially inserting the first lever part 56 into the interior of the support sleeve 28, such being accomplished by inserting the lever part 56 and the center pivot 58 through main opening 42. When so disposed the pivot pin 58 of the lever is snapped into the slot-like groove 48, with the lever parts being positioned within and projecting out through the narrow elongate slot 44. The second lever part 57 projects outwardly through the slot 44 so that the outer end of the second lever part 57, and specifically the nub 59 thereon, is aligned generally with the blind bore 46. The spring 38 has one end thereof seated in the blind bore, and the other end fitted over the projection or nub 59, whereby the spring 38 urges the latching lever to pivot about the pivot pin 58 so that the flat surface 61 on the first lever part 56 is always urged radially inwardly toward a position of latching engagement with the arm upright 14. In this regard, the arm upright as noted above has a plurality of vertically spaced slots 37 extending transversely across the outer surface thereof, which slots 37 each have a flat bottom wall 62 adapted for engagement with the flat edge 61 on the first lever part 56 when the latter is in a latched position wherein it is engaged within one of the slots.

Figure 13:
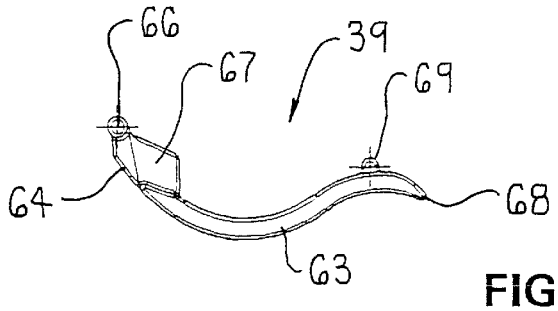
FIG. 13 is a top view of the actuating paddle shown in FIG. 11.
Figure 11:
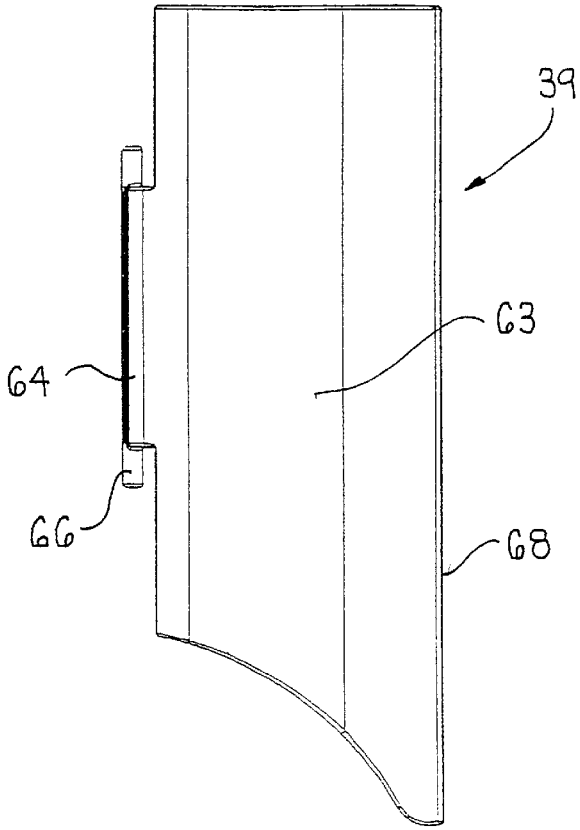
FIG. 11 is a rear elevational view showing the actuating paddle which mounts to the mounting part of the back shell.
Figure 12:
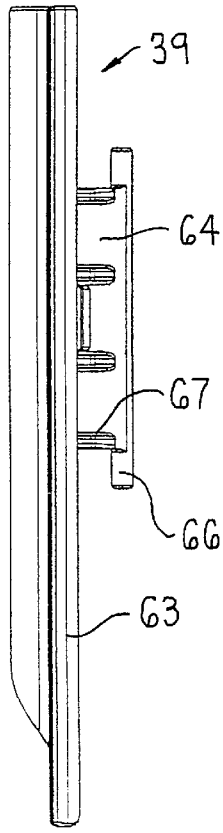
FIG. 12 is a side elevational view of the actuating paddle shown in FIG. 11.

The latching mechanism also includes the activating member or paddle 39, the latter also effectively functioning as a shroud for enclosing the latching mechanism. This activating paddle 39 as illustrated in FIGS. 11–13 includes a main panel part 63 which, in cross section, has a generally arcuate configuration similar to the outer configuration of the support sleeve 28. The panel part 63 of the paddle 39 has a flange 64 associated with one upright edge thereof, the latter in turn being joined to a vertically elongate hinge pin 66 which is offset inwardly from the panel 63 and flange 64. The hinge pin 66 is of sufficient vertical extent that upper and lower edge portions thereof project respectively vertically above and below the extremities of the flange 64 as illustrated in FIGS. 11–12. A plurality of reinforcing ribs 67 couple the pin 66 and flange 64 to the main panel part 63. The main panel part 63 of the paddle 38 has, adjacent the opposite longitudinally extending vertical edge 68 thereof, a small pin or nub 69 protruding inwardly therefrom at a location which is approximately horizontally aligned with the center of the flange 64.

The activating paddle 39 is mounted to the support sleeve 28 by initially positioning the paddle adjacent the T-shaped opening 41 so that the hinge pin 66 on the paddle is aligned with the slot-like parts 43 associated with one edge of the main opening 42. The paddle is then moved inwardly so that the hinge pin 66 passes through the slot-like openings 43, with the hinge pin then being moved transversely across the main opening 42 so as to be aligned with and snapped into the slot-like groove 49 disposed adjacent the other edge of the main opening 42. When so positioned, the main panel part 63 of the paddle 39 effectively overlies the entirety of the T-shaped opening 41, and the free edge 68 of the paddle is disposed such that the protrusion 69 is positioned to abuttingly contact a back surface 71 provided on the free end of the second lever part 57 substantially as illustrated in FIGS. 15–16.

Figure 15:
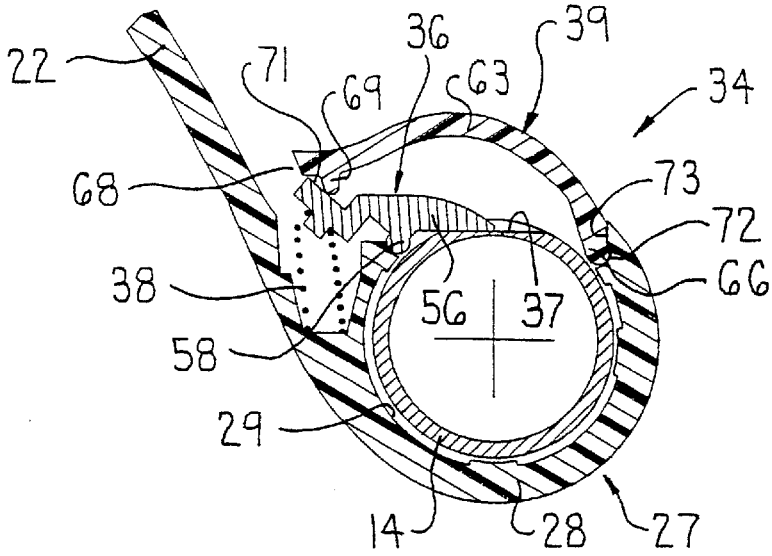
FIG. 15 is an enlarged, fragmentary cross sectional view taken through the arm mounting part of the back shell and showing the height-adjusting mechanism in its latched position.

The spring 38 acting against the latching lever swings the latter outwardly (clockwise in FIG. 15) which in turn acts against the free end of the paddle 39 to swing the latter outwardly into the latched position as illustrated by FIG. 15. In this latched position, the outward swinging of the paddle 39 is restricted by the opposed stop surfaces 72 on the paddle and 73 on the support sleeve contacting one another. In this latched position, however, the spring 38 exerts little, if any, biasing force.

Figure 16:
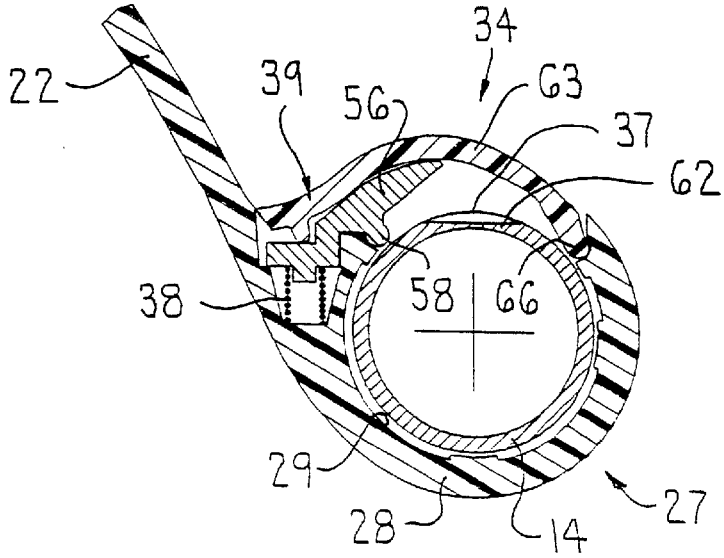
FIG. 16 is a view corresponding to FIG. 15 but showing height-adjusting mechanism in an unlatched position.

When the latch is to be released, however, the paddle 39 is manually depressed toward the support sleeve 28 and pivoted inwardly (counter-clockwise in FIG. 15) into the position illustrated in FIG. 16. In this position, the free end of the paddle 39 acts against the end of lever part 57 causing the latter to be moved inwardly to effect compression of the spring 38, and simultaneously causing the latching lever part 56 to be swung outwardly so as to disengage the latching slot 37.

With the arrangement of the present invention, the height of the back member 21 can be adjusted relative to the chair seat 11 while the user of the chair is seated. To effect such height adjustment, the seated occupant reaches down and somewhat rearwardly so as to engage right and left hands with the respective right and left mounting parts of the chair back. The hands are positioned so that the fingers project outwardly around the support sleeves for engagement with the respective activating paddles 39. The fingers on both hands are then simultaneously pressed against the activating paddles 39 so that the paddles swing inwardly into the unlatching position illustrated in FIG. 16. During this inward swinging of the activating paddles, the free end of the activating paddle acts against the lever part 57 of the latching lever and swings it inwardly about pivot 58 causing compression of the spring 38. This causes the first lever part 56 to swing outwardly so as to disengage the slot 37 on the arm upright 14. With both latches disengaged, and with the occupant's hands continuing to grip the support sleeves 28, the user can then manually slide the back member 21 upwardly or downwardly on the arm uprights 14 to the desired elevation. When reaching the desired elevation the user releases finger pressure on the paddle members 39 so that the springs 38 urge the latching levers back toward the latching positions and simultaneously swing the paddle members outwardly to the latched position illustrated by FIG. 15. If the latching lever does not directly align with one of the slots 37, then the user can slidably displace the back member a small vertical distance until the latching levers are spring urged into the nearest adjacent slot 37.

Since the latching members automatically remain in the latched position due to cooperation with the coil springs 38, the chair hence can be readily moved about and even lifted by gripping the back member, without causing movement or separation of the back with respect to the remainder of the chair.

The back member 21 is preferably formed as a monolithic one-piece shell constructed of a plastics material and is suitably contoured so as to comfortably support the user's back, with the construction of the shell providing sufficient resiliency to enhance user comfort. It will be appreciated, however, that the back shell can also be provided with cushions and/or upholstered coverings thereover, as is conventional in chair constructions, if desired.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair, comprising:

a base;

a seat supported on the base for accommodating an occupant;

right and left generally parallel uprights respectively positioned adjacent right and left sides of the seat in the vicinity of rear corners thereof, said uprights being upwardly cantilevered relative to said seat;

a back positioned adjacent a rear edge of said seat and projecting upwardly therefrom;

said back including a one-piece back member defined by a large upright main panel and having right and left support sleeves fixedly joined to said main panel adjacent respective right and left edges thereof, said right and left support sleeves defining therein generally parallel upright openings so that each said support sleeve slidably surrounds a respective said upright;

right and left manually-releasable latching mechanisms cooperating between the respective right and left support sleeve and the respective right and left upright for maintaining the back member fixed relative to the uprights when the latching mechanisms are in a latched position, said back member being vertically movable relative to the uprights when the right and left latching mechanisms are unlatched;

said right and left latching mechanisms being simultaneously manually actuatable into an unlatched position to permit height adjustment of the back member due to simultaneous gripping of the right and left latching mechanisms by the respective right and left hands of a seated occupant; and right and left armrest structures mounted on the respective upwardly-cantilevered right and left uprights so as to be positioned adjacent opposite sides of the seat.

2. A chair according to claim 1, wherein the armrest structure includes an arm cap having a downwardly projecting support element which is slidably telescopically engaged with the respective upright, and a height adjusting mechanism cooperating with each said upright and the respective armrest structure for permitting the respective armrest structure to be vertically positionally adjusted.

3. A chair according to claim 1, wherein said back member including the support sleeves as fixed to the main panel are defined by a one-piece monolithic member constructed of a plastics material.

4. A chair according to claim 1, wherein the latching mechanism includes:

a latching member which is movably carried on the respective support sleeve and is spring-urged into latching engagement with the respective upright, and an activating member which is movably carried on the respective support sleeve and is manually movable by a seated occupant to effect corresponding movement of the latching member away from a latched position.

5. A chair according to claim 4, wherein the latching member and the activating member are independently movably supported on and carried by the respective support sleeve.

6. A chair according to claim 5, wherein one of the latching and activating members is pivotably mounted on the support sleeve.

7. A chair according to claim 5, wherein the activating member is positioned adjacent an exterior peripheral surface of the support sleeve and overlies and encloses the latching member.

8. A chair according to claim 7, wherein the activating member is supported for swinging movement about a generally vertical axis.

9. A chair, comprising:

a base;

a seat supported on the base for accommodating an occupant;

a back positioned adjacent a rear edge of said seat and projecting upwardly therefrom;

a pair of generally parallel and sidewardly spaced uprights positioned adjacent said seat and projecting upwardly relative thereto;

a pair of arm rests positioned in upwardly spaced relation from the seat and adjacent opposite sides thereof, each said arm rest being mounted on a respective one of said uprights adjacent an upper end thereof;

said back having a pair of sidewardly-spaced vertically-elongate support sleeves fixedly associated therewith and respectively disposed in vertical slidable supportive engagement with the uprights to permit the height of the back to be adjusted relative to the seat;

a pair of independently and manually releasable latching mechanisms each cooperating between one said support sleeve and the respective upright for permitting the height of the back to be vertically selected between one of a plurality of different vertical positions; and each said latching mechanism including a spring-biased latching member movably mounted on the respective support sleeve and urged toward a position of latching engagement with the respective upright, and a manually engagable activating member movably mounted on the respective support sleeve and disposed adjacent the surface of the support sleeve so as to be manually engaged and depressed to effect a corresponding releasing movement of the latching member to disengage the latching member from the respective upright.

10. A chair according to claim 9, wherein the back comprises a one-piece back member constructed of a plastics material and having a three dimensional contour for contact with an occupant's back, and said support sleeves being integrally and fixedly joined to said back member adjacent opposite sides thereof.

11. A chair according to claim 10, wherein said back is supported solely by the engagement of the support sleeves on the uprights and the connection therebetween by the latching mechanisms.

12. A chair according to claim 9, wherein said uprights are positioned adjacent opposite rear corners of said seat and are cantilevered upwardly relative to the seat, and wherein said arm rests are cantilevered forwardly from the upper ends of said uprights.

13. A chair according to claim 12, wherein the activating member comprises an elongated activating lever which adjacent one end is pivotally supported on the respective support sleeve for swinging movement transverse to the elongated direction of the support sleeve, said activating lever projecting away from said one end thereof at least partially around the periphery of said support sleeve so that manual circumferential gripping of the support sleeve by a seated occupant enables the activating lever to be depressed to effect release of the latch member.

14. A chair, comprising:

a base;

a seat supported on the base for accommodating an occupant;

right and left generally parallel uprights positioned in the vicinity of rear corners of the seat and being upwardly cantilevered relative to said seat;

a back positioned adjacent a rear edge of said seat and projecting upwardly therefrom;

said back including a back member defined by a large upright contoured main panel having right and left vertically-elongate support sleeves fixedly joined thereto adjacent respective right and left sides thereof, said main panel and the support sleeves being constructed in one piece of a plastics material, and said right and left support sleeves defining therein generally parallel upright openings so that each said support sleeve slidably surrounds a respective said upright to permit the height of the back member to be adjustably positioned relative to the seat;

right and left independently and manually releasable latching mechanisms cooperating between the respective right and left support sleeves and the respective right and left uprights for maintaining the back member fixed relative to the uprights when the latching mechanisms are in a latched position, said back member being vertically movable relative to the uprights to adjust the height of the back member when the right and left latching mechanisms are unlatched;

each said latching mechanism including a manually-movable activating lever which is positioned adjacent the exterior of the respective support sleeve and is pivotally supported on the support sleeve for swinging movement generally perpendicular to the elongated direction of the support sleeve, said activating lever being depressed inwardly relative to the support sleeve to effect release of the latching mechanism when an occupant's hand grips around the support sleeve and exerts inward pressure against the activating lever so as to swing the activating lever inwardly toward the respective upright.

15. The chair according to claim 14, wherein the latching mechanism includes a latching lever coacting between the support sleeve and the respective upright and pivotally supported for swinging movement generally parallel to the swinging movement of the activating lever, the latching lever being spring-urged into a position of latching engagement with the respective upright, said activating lever when manually swingably depressed effecting a corresponding swinging movement of the latching lever into a released position wherein it is disengaged from the upright to permit the back member to be vertically slidably displaced relative to the uprights.

16. A chair according to claim 15, wherein the support sleeve has an opening formed through a peripheral wall thereof for accommodating the latching lever therein, and said activating lever being an enlarged plastic shroud which is of arcuate cross-section and pivotally mounts to the support sleeve so as to extend over the opening and enclose the latching lever thereunder.

17. A chair according to claim 14, wherein the support sleeves are fixed to opposite sides of the main back panel adjacent a lower end of the back panel so that the support sleeves, when slidably engaged with the uprights, are positioned adjacent but disposed slightly upwardly from rear corners of the seat so as to enable a seated occupant to simultaneously grip both support sleeves and manually activate the respective latching mechanisms.

* * * * *